US009693923B2

(12) United States Patent
Aboujaoude et al.

(10) Patent No.: US 9,693,923 B2
(45) Date of Patent: Jul. 4, 2017

(54) EXTREMITY SURGICAL POSITIONING DEVICE

(76) Inventors: Emad S. Aboujaoude, Portland, OR (US); Paul W. Scott, IV, San Luis Obispo, CA (US)

( * ) Notice: Subject to any disclaimer, the term of this patent is extended or adjusted under 35 U.S.C. 154(b) by 63 days.

(21) Appl. No.: 13/397,783

(22) Filed: Feb. 16, 2012

(65) Prior Publication Data

US 2012/0318278 A1 Dec. 20, 2012

Related U.S. Application Data

(60) Provisional application No. 61/443,318, filed on Feb. 16, 2011.

(51) Int. Cl.

| | |
|---|---|
| ***A61G 13/12*** | (2006.01) |
| ***A61G 13/00*** | (2006.01) |
| ***A61G 7/075*** | (2006.01) |
| ***A61G 7/10*** | (2006.01) |
| ***A61G 13/10*** | (2006.01) |

(52) U.S. Cl.

CPC ..... *A61G 13/0036* (2013.01); *A61G 7/075* (2013.01); *A61G 7/1092* (2013.01); *A61G 7/1096* (2013.01); *A61G 13/101* (2013.01); *A61G 13/125* (2013.01); *A61G 13/1235* (2013.01); *A61G 13/1245* (2013.01); *A61G 13/1295* (2013.01); *A61G 2200/56* (2013.01); *A61G 2200/58* (2013.01)

(58) Field of Classification Search

CPC .. A61G 13/0036; A61G 13/101; A61G 13/12; A61G 13/1205; A61G 13/1235; A61G 13/1245; A61G 7/00; A61G 7/065; A61G 7/075; A61G 7/1082; A61G 7/1092; A61G 7/1096; A61G 13/00; A61G 2013/0045; A61G 2013/0063; A61G 2013/0072; A61G 2013/0081

USPC ..... 128/845, 877–882; 602/32, 33, 35, 36, 602/39, 40; 5/646, 648, 623, 624

See application file for complete search history.

(56) References Cited

U.S. PATENT DOCUMENTS 4,974,830 A * 12/1990 Genovese et al. ..... 601/29
5,290,222 A 3/1994 Feng et al.
(Continued)

*Primary Examiner* — Keri J Nelson
(74) *Attorney, Agent, or Firm* — J. Curtis Edmonson (Patent Attorney); Anitha Shankar Nacayan (Patent Attorney); Law Offices of J. Curtis Edmondson

(57) ABSTRACT

The present inventive subject matter describes a device and system for positioning, adjusting, and stretching a patient's extremity for surgical procedures where alignment is critical and minute adjustments may be required repeatedly. The device helps in maintaining the patient's extremity stationary, once the physician has selected the precise position for the elected procedure. The device uses using a combination of an articulating and a rotating frame, support plates and support rings that are attached to the extremity surgical positioning system. The system acts as a limb splint that is firmly attached to the surgical table. The support plates are attached to the patient via a series of adjustable straps preventing the extremity from moving independently of the support plate. A locking rack and gear configuration has adjustable locking pivot points that are positioned along and within the outer/inner proximal tube and outer/inner distal tube that lengthens or rotates various portions of the extremity.

10 Claims, 2 Drawing Sheets

(56) References Cited

U.S. PATENT DOCUMENTS

| | | | | |
|---|---|---|---|---|
| 6,491,273 | B2 | 12/2002 | King et al. | |
| 6,533,741 | B1 * | 3/2003 | Lee | A61F 5/05858 128/878 |
| 6,953,443 | B2 | 10/2005 | Hay | |
| 7,152,261 | B2 * | 12/2006 | Jackson | 5/600 |
| 7,175,602 | B2 * | 2/2007 | Diaz et al. | 601/5 |
| 7,832,035 | B2 * | 11/2010 | Walczyk | 5/648 |
| 7,951,097 | B2 * | 5/2011 | Schaeffer | 601/5 |
| 2004/0133979 | A1 * | 7/2004 | Newkirk et al. | 5/600 |
| 2004/0167455 | A1 * | 8/2004 | Smart | 602/32 |
| 2009/0030353 | A1 * | 1/2009 | Bonutti et al. | 601/5 |
| 2009/0308400 | A1 * | 12/2009 | Wilson et al. | 128/845 |
| 2010/0018537 | A1 * | 1/2010 | Soto et al. | 128/845 |

* cited by examiner

EXTREMITY SURGICAL POSITIONING DEVICE

PRIOR APPLICATIONS

The present application incorporates by reference the Provisional Patent Application 61/443,318 filed on Feb. 16, 2011, which is incorporated herein by reference.

BACKGROUND

The present inventive subject matter relates to an extremity surgical positioning device. In particular, a device or fixture that holds the limb of a patient stationary, so that medical procedures can be performed.

Traditionally surgery on the limb of a patient is accomplished by two individuals: the surgeon who is responsible for the actual operation on the limb and the assistant, who is responsible for holding the limb in the proper position while surgery occurs. To improve the job of the assistant, a number of devices are employed to help hold the limb in position. These devices vary, but typically consist of pads, straps, and various fixtures. For example, the Bryton Corporation (Indianapolis, Ind.) markets a number of products that aid in surgery. Also, Allen Medical Systems (Acton, Mass.), markets a variety of surgical positioning aids.

U.S. Pat. No. 5,290,222 (Mar. 1, 1994) issued to Guhl discloses a non-invasive distraction system for ankle arthroscopy that utilizes a sling wrapped around the patient's ankle with an adjustable tension device that provides distraction of the leg and joints because the knee is cradled in a conventional urology leg holder and held relatively stationary. The device can be mounted on a standard operating table and utilizes the bent knee and the patient's weight to aid in the distraction.

U.S. Pat. No. 6,953,443 (Oct. 11, 2005) issued to Hay discloses a tibial distraction device that is essentially a triangular ramp that functions similarly to Guhl, but is not mounted directly to the operating table.

U.S. Pat. No. 6,491,273 (Dec. 10, 2002) issued to King et al. discloses a fluid filled "multi-joint arm-like" support with releasable and lockable limb sections for "holding, tools, instruments and the like."

Although these methods and devices have their uses, they have their pitfalls because they are not very precise, are prone to slippage, and can be difficult to adjust.

In general there is a need for an extremity surgical positioning device that provides:

- Better access to surgical sites of the upper and lower extremities
- Distraction of fractures and/or joints
- Compression of fractures post re-alignment
- Ability to rotate the distal aspect of the limb during distraction or compression.
- Reduce the need for external fixation traction
- Better access of intra-operative radiography
- Un-obstructed x-ray view of bones through radio-lucent material.

It is therefore an object of the present inventive subject matter to provide an extremity surgical positioning device that is easily adjusted, capable of distraction, precise, easily mounted and dismounted to the operating table and slip resistant.

SUMMARY

The present inventive subject matter overcomes problems in the prior art by providing a device or fixture for positioning a patient's limb, whether that may be an upper or lower extremity.

In various operations and medical procedures it is required that the extremity is held stationary and located and adjusted precisely. An example of this would be surgery to pin or reconstruct a shattered bone. Alignment is critical and minute adjustments may be required. Furthermore, the device must not allow the patients extremity to move once the surgeon has selected the precise position for the elected procedure.

The present invention achieves these desired results through a combination of an articulating and rotating frame with thigh/upper arm supporting plate, lower leg/forearm supporting plate, and a foot/hand supporting plate that attach to support arms and act as a limb splint that is firmly anchored or attached to the surgical table. The supporting plates are securely attached to the patient via a series of adjustable straps around the patient's thigh/upper arm, shin/forearm, ankle/wrist, and foot/hand which not only prevents the extremity from moving independently of the supporting means, but do so in a non-invasive manner to the patient's tissue and skin.

Once the patient's extremity is securely attached to the supporting plates via the straps the surgeon can manipulate the extremity in a number of ways due to a rack and gear configuration and a myriad of adjustable pivot points positioned along and within the support arms to either lengthen or rotate various portions of the extremity against each other to align the extremity such as in repositioning of the limb or in setting a broken limb for example.

Each of these adjustable pivot points and rack and gear components have a means of locking them in a stationary position either by a friction means or by a spring and pawl mechanism. This aids in the precise adjustment of the extremity.

The inventive subject matter also describes an extremity surgical positioning device having a mount configurable to connect to a table, chair, or other equipment used for supporting and/or positioning a patient during surgery. The mount is rotatable in two degrees of freedom along the plane of the operating table; a proximal segment and distal segment having two opposing ends, and wherein each segment is telescopically retractable and extendable, and wherein one end of the proximal segment is connected to the table clamp; a proximal segment has an attachment point and a rotatable support point.

These and other embodiments are described in more detail in the following detailed descriptions and the figures. The foregoing is not intended to be an exhaustive list of embodiments and features of the present inventive subject matter. Persons skilled in the art are capable of appreciating other embodiments and features from the following detailed description in conjunction with the drawings.

LIST OF REFERENCE CHARACTERS

001: Patient
002: O.R. Table (Generic)
100: Extremity Surgical Positioning System
105: Table Clamp Cam-Lock

110: Table Clamp
115: Base
120: Rotary Joint Cam-Lock (Locks Adduction/Abduction)
125: Rotary Joint (Adduction/Abduction)
130: Proximal Hinge (Proximal Joint Flexion/Extension)
135: Proximal Hinge Cam-Lock (Locks Proximal Joint Flexion/Extension)
140: Outer Proximal Tube
145: Outer Proximal Tube Cam-Lock (Locks Int/Ext Rotation of Proximal Joint and Distraction/Compression)
150: Proximal Support Cam-Lock
155: Proximal Support Arm
160: Proximal Support Plate
165: Inner Proximal Tube
170: Proximal Distraction/Compression Ring
175: Proximal Distraction/Compression Engagement Lever
180: Intermediate Hinge (Distal Limb Flexion/Extension)
185: Intermediate Hinge Cam-Lock (Locks Distal Limb Flexion/Extension)
190: Distal Limb Support Cam-Lock
195: Distal Limb Support Arms
200: Distal Limb Support Plate
205: Distal Limb Support Plate Lock Knob
210: Outer Distal Limb Tube
215: Distal Tube Clocking Ring
220: Inner Distal Limb Tube
225: Distal Limb Distraction/Compression Ring
230: Distal Limb Distraction/Compression Engagement Lever
235: Foot/Hand Support Clocking Lever
240: Foot/Hand Plate Ball Joint Cam-Lock
245: Foot/Hand Support Arm
250: Foot/Hand Plate Ball Joint
255: Foot/Hand Plate
260: Ring Support
265: Ring Support Cam-Lock
270: Ring Support Rings (Vary in Size)
275: Ring Support Ring Retention Pin

DETAILED DESCRIPTION

Figure 1:
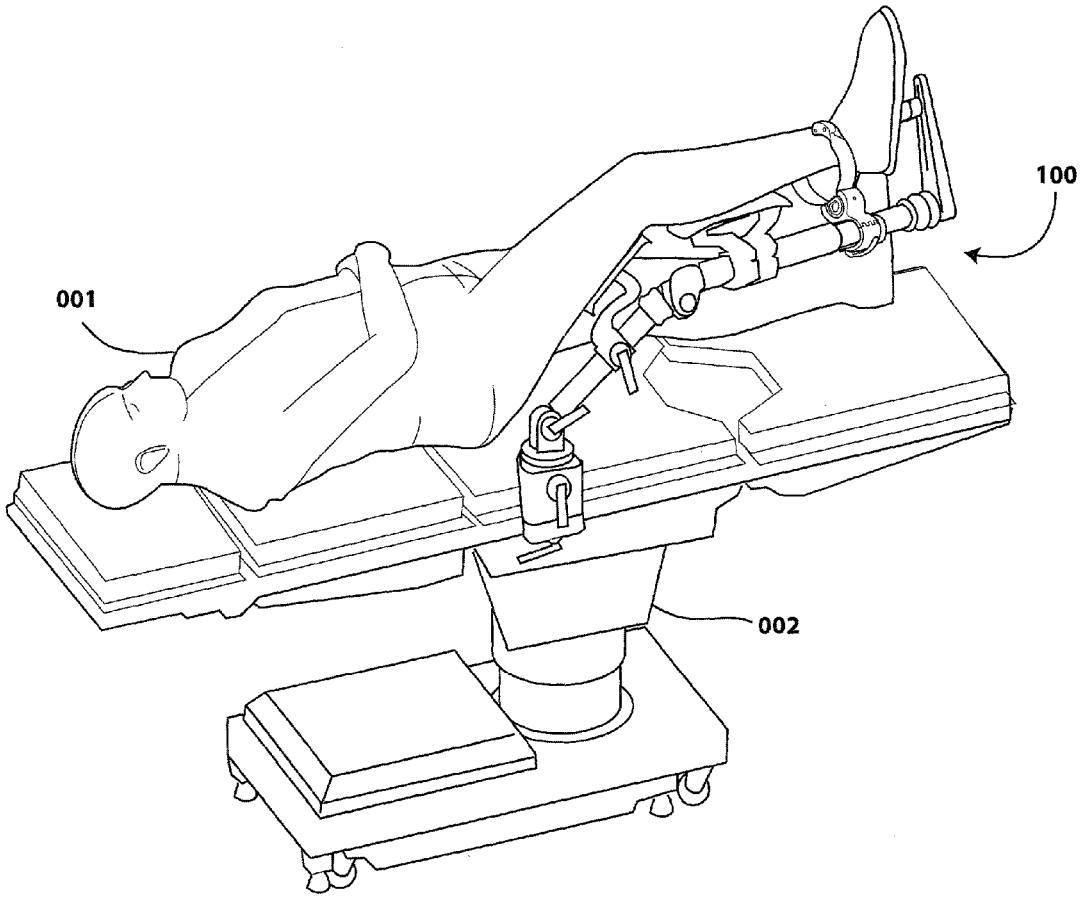
FIG. 1 is an oblique view of the Extremity Surgical Positioning Device with patient's lower extremity positioned in it.
Figure 2:
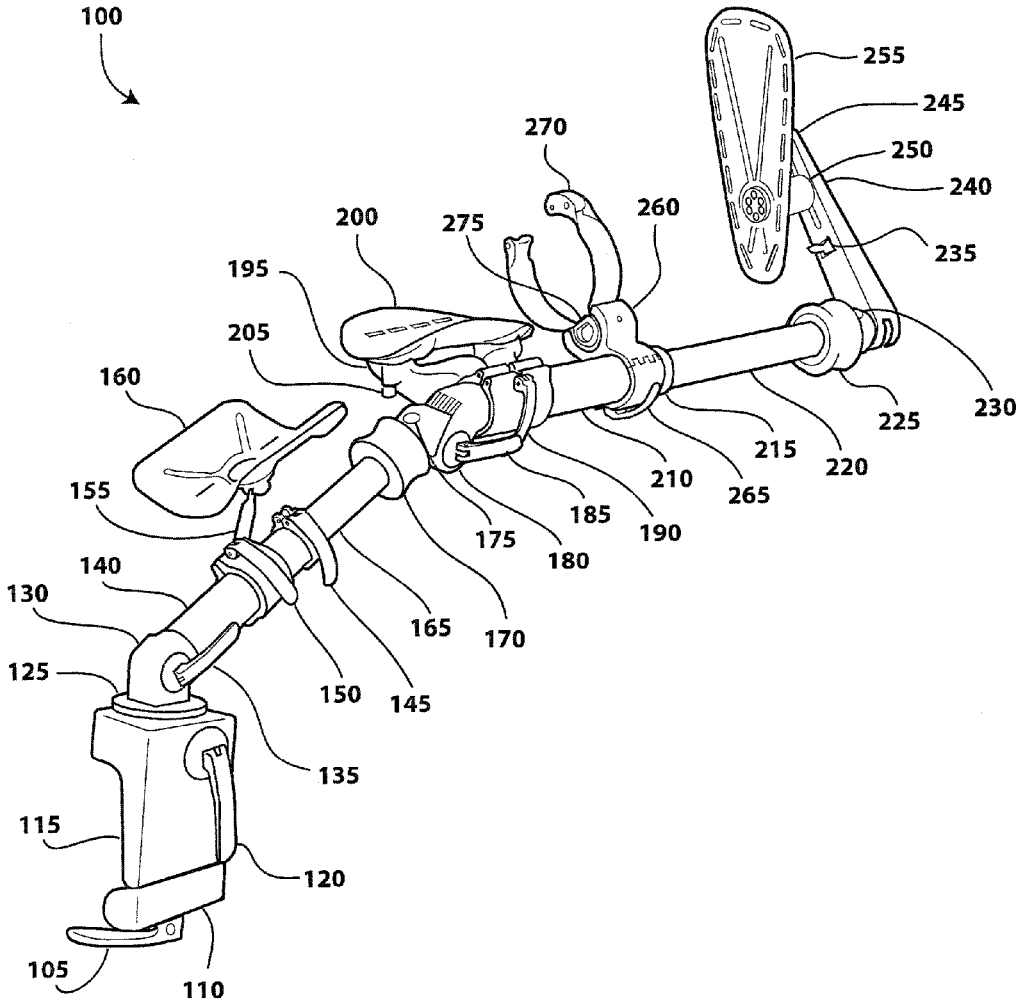
FIG. 2 is an oblique view of the Extremity Surgical Positioning Device with identification markers for referenced characters.

Representative embodiments according to the inventive subject matter are shown in FIGS. 1-2, wherein similar features share common reference numerals.

Description of the Inventive Subject Matter

The inventive subject matter of a multi-purpose positioning device has the following method of operation.

FIG. 1 shows an oblique view of a patient 001, an operating room table 002, an extremity surgical positioning system (hereinafter "positioning system").

FIG. 2 shows an oblique view of the positioning system 100, which shows a table clamp 110, table clamp cam-lock 105, a positioning system base 115, rotary joint cam-lock 120, and a rotary joint 125 connected to proximal hinge 130, with a proximal hinge cam-lock 135, an outer proximal tube 140, outer proximal tube cam-lock 145, proximal limb support cam-lock 150, proximal limb support arm 155, proximal limb support plate 160, inner proximal tube 165, proximal limb distraction/compression ring 170, proximal limb distraction/compression engagement lever 175.

The inner proximal tube 165 is connected to an intermediate hinge 180, an intermediate hinge cam-lock 185, distal limb support cam-lock 190, distal limb support arms 195, distal limb support plate 200, distal limb support plate lock knob 205, outer distal limb tube 210, outer distal tube clocking ring 215, inner distal limb tube 220, distal limb distraction/compression ring 225, distal limb distraction/compression engagement lever 230.

The inner distal tube 220 is connected to a foot/hand support clocking lever 235, foot/hand plate ball joint cam-lock 240, foot/hand support arm 245 connects to a foot/hand plate ball joint 250 and a foot/hand plate 255.

A modular ring support 260 can be attached and locked to the outer proximal tube or outer distal tube with the ring support cam-lock. The ring support ring 270 is held in the ring support 260 by a ring support ring retention pin 275.

The configuration of the aforementioned inventive subject matter should not be limited to any single embodiment described, instead all possible configurations that can be implemented and derived by one skilled in the arts are understood to be embodied herein.

Method and Operation of the Inventive Subject Matter

The inventive subject matter of a multi-purpose positioning device has the following method of operation.

The patient is placed into position on the operating table. FIG. 1 shows a patient 001, with an extremity surgical positioning system 100, this is mounted to an operating room table 002, via a table clamp 110, and lockable into position with the table clamp cam-lock 105. The lower extremity is placed in the extremity surgical positioning system 100, the proximal lower extremity is placed on the proximal limb support plate 160, the patient's distal lower extremity is placed on the distal limb support plate 200, and the foot is placed against the foot/hand plate 255. The limb is further secured to the support plate via commonly used sterile strapping and wraps.

The length of the outer proximal limb tube 140, and inner proximal limb tube 165, are adjustable to provide for specific patient limb length. This is also used for distraction/compression and is actuated through the proximal limb distraction/compression engagement lever 175, and fine movements are controlled through the proximal distraction/compression ring 170. The length of the outer distal limb tube 210, and inner distal limb tube 220, are adjustable to provide for specific patient limb length. This is also used for distraction/compression and is actuated through the distal limb distraction/compression engagement lever 230, and fine movements are controlled through the distal distraction/compression ring 225. The foot/hand support arm 245, is adjustable for internal/external rotation and/or valgus/varus alignment of the lower limb and is lockable in to position from the foot/hand support clocking lever 235.

The foot/hand plate ball joint 250, can be adjusted for height, flexion, extension, pronation, supination and rotational movements and is lockable into position from the foot/hand plate ball joint cam-lock 240.

This extremity surgical positioning system 100, allows for the use of variety of ring support rings 270, that are placed in a ring support 260, maintained in place by a ring support retention pin 275, and secured to the outer proximal limb tube 140 and/or distal limb tube 210, and lockable into position from the ring support cam-lock 265.

An extremity can be flexed/extended at the proximal joint through the proximal hinge 130, and lockable into position from the proximal hinge cam-lock 135. Abduction/adduction is controlled via the rotary joint 125, and lockable into position via the rotary joint cam-lock 120. Internal/external rotation is controlled through pivoting of the outer proximal limb tube 140, and inner proximal limb tube 165, and lockable from the outer proximal limb tube cam-lock 145.

An extremity can be flexed/extended at the intermediate joint through the intermediate hinge 180, and lockable into position from the intermediate hinge cam-lock 185. Abduction/adduction is controlled via the rotary joint 125, and lockable into position via the rotary joint cam-lock 120.

The materials as depicted in FIG. 2, can be fabricated from materials generally used in operating room environments. These materials may be also constructed from metal, fiberglass, carbon fiber or plastic. The use of wood laminates and/or wood can be utilized. In operating environments where X-Rays will need to be taken while the limb is positioned into the extremity surgical positioning system 100, the material should be fabricated from radio-lucent material.

Certain Advantages of the Inventive Subject Matter Over the Prior Art

The inventive subject matter is a multi-purpose positioning device that can be used for certain surgical procedures, including, but not limited to, ankle arthroscopy, tibia fractures, fibula fractures, bimaleollar/trimaleollar fractures as well as pylon fractures. The inventive subject matter provides for:

- multiplanar motion for fracture reduction
- quick lockdown of a reduction through positioning with distraction and compression
  - control of the varus/valgus drift after reduction
- provide a consistent, easy to manipulate, control, and measure sterile non-invasive distraction was well as a compression device.
  - eliminates need for external fixation pins and unnecessary additional surgical wounds.
  - less trays/equipment to have available on the surgical field.
- quick limb position changes for easier surgical approach
  - bilateral wound closure access for surgeon and the assistant
- raised limb elevation during surgery minimizing need for tourniquet use
- eliminate need for sand bag/bump under buttock to control ankle/foot neutral position
  - eliminates concerns of lumbar spine clearance
  - eliminates concerns of low back pain complications in patients with past history of low back pain/injury/surgeries
- devise design provides better surgical site access There is an overall reduction on operation time due to better surgical site access, quicker fracture reduction, faster x-ray time, and faster wound-closure through better positioning.

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

All patent and non-patent literature cited herein is hereby incorporated by references in its entirety for all purposes.

We claim:

1. A patient limb positioning device, comprising:

an attachment means for rigidly fixing the device to a table, chair, or other equipment used for supporting and positioning a patient;

a rotary joint placed atop the attachment means for abduction or adduction of a limb of the patient;

a proximal limb segment having an outer proximal limb segment and an inner proximal limb segment adapted to be telescopically connected to one another;

a proximal limb distraction or compression engagement lever to actuate distraction or compression of a proximal portion of the patient's limb, wherein fine movements are controlled by a proximal distraction or compression ring;

a proximal hinge connected to the rotary joint and the outer proximal limb segment for flexion or extension of the proximal portion of the limb of the patient;

a distal limb segment having an outer distal limb segment and an inner distal limb segment adapted to be telescopically connected to one another;

a distal limb distraction or compression engagement lever to actuate distraction or compression of a distal portion of the patient's limb, wherein fine movements are controlled by a distal distraction or compression ring;

an intermediate hinge connected to the inner proximal limb segment and the outer distal limb segment for flexion or extension of the distal portion of the limb of the patient;

a proximal limb support plate fastened to the proximal limb segment;

a distal limb support plate and a support ring fastened to the distal limb segments; and a hand/foot plate connected to a distal end of the patient limb positioning device;

wherein, one or more of the proximal limb support plate, distal limb support plate, and support ring of the patient limb positioning device are radiolucent.

2. The patient limb positioning device, as in claim 1, wherein each one of the proximal limb support plate, distal limb support plate, and support ring includes a cam-lock adapted to reposition and lock each one of the proximal limb support plate, distal support plate, and support ring.

3. The patient limb positioning device, as in claim 1, wherein the attachment means is adapted to be placed under the patient, and held in place by at least a portion of the patient's body weight.

4. The patient limb positioning device, as in claim 1, wherein the hand/foot plate is a hand support with support for fingers or a foot support with support for toes.

5. The patient limb positioning device, as in claim 1, wherein the one or more of the proximal limb support plate, distal limb support plate, and support ring are one or more concave surfaces.

6. The patient limb positioning device, as in claim 1, wherein the support ring is adapted to provide a valgus compression to the distal portion of the limb of the patient.

7. The patient limb positioning device, as in claim 1, wherein the support ring is adapted to provide a varus compression to the distal portion of the limb of the patient.

8. A patient limb positioning device, comprising:

a clamp for rigidly fixing the device to a table, chair, or other equipment used for supporting the patient;

an arm having corresponding segments, the segments connected to one another via at least one joint with one end of the arm attached to the clamp and the other end of the arm adapted to be attached to an extremity positioning plate for receiving and supporting the hand and fingers or foot and toes, the at least one joint adapted to allow rotational motion of the arm and the segments to one another, the at least one joint adapted to allow linear displacement of the arm and the segments to one another;

at least two radiolucent support plates and at least one radiolucent support ring adapted to receive and support a limb of the patient or portions thereof, the at least two support plates and the at least one support ring fastened to the segments of the arm;

at least one distraction or compression engagement lever to actuate distraction or compression of at least a portion of the limb;

the at least two support plates and the at least one support ring adapted to be rotationally repositionable and lockable along the circumference of the arm;

the at least two support plates and the at least one support ring adapted to be linearly repositionable and lockable along the length of the arm.

9. The patient limb positioning device, as in claim 8, wherein the clamp is adapted to be placed under the patient, and held in place by at least a portion of the patient's body weight.

10. A method of positioning a limb of a patient, the method comprising:

placing the patient on an operating table, chair, or other equipment used for supporting and positioning a patient during surgery or radiography;

securing a multisegmented device to the operating table, where the device comprises a series of one or more telescopically adjustable and lockable segments;

adjusting the length of the one or more telescopically adjustable segments, in order to secure the limb of the patient to the device;

changing and locking the length of the one or more telescopically adjustable segments;

supporting both a proximal portion, by way of a radiolucent proximal limb support plate, and a distal portion, by way of at least one of a radiolucent distal limb support plate, a support ring, and a hand/foot plate, of the limb;

applying tension along at least a portion of the limb; and, applying compression along at least a portion of the limb actuating a distraction or compression of at least a portion of the limb with the help of limb distraction or compression engagement lever.

* * * * *